US011971036B2

(12) United States Patent
Li et al.

(10) Patent No.: US 11,971,036 B2
(45) Date of Patent: Apr. 30, 2024

(54) COMPRESSOR AND REFRIGERATION DEVICE WITH AN OIL RETURN CHANNEL HAVING A FIRST RELATIVE DISTANCE TO AN INNER-SIDE WALL

(71) Applicant: GUANGDONG MEIZHI PRECISION-MANUFACTURING CO., LTD., Guangdong (CN)

(72) Inventors: Yang Li, Guangdong (CN); Lingao Lu, Guangdong (CN); Hongjun Cao, Guangdong (CN)

(73) Assignee: GUANGDONG MEIZHI PRECISION-MANUFACTURING CO., LTD., Guangdong (CN)

( * ) Notice: Subject to any disclaimer, the term of this patent is extended or adjusted under 35 U.S.C. 154(b) by 105 days.

(21) Appl. No.: 17/561,149

(22) Filed: Dec. 23, 2021

(65) Prior Publication Data

US 2022/0112897 A1 Apr. 14, 2022

Related U.S. Application Data

(63) Continuation of application No. PCT/CN2020/136363, filed on Dec. 15, 2020.

(30) Foreign Application Priority Data

Jun. 30, 2020 (CN) ..... 202010613519.2

(51) Int. Cl.
*F04C 29/02* (2006.01)
*F04C 23/00* (2006.01)
(Continued)

(52) U.S. Cl.
CPC ..... *F04C 29/028* (2013.01); *F04C 23/008* (2013.01); *F04C 29/005* (2013.01);
(Continued)

(58) Field of Classification Search
CPC ..... F04C 15/0088–0092; F04C 29/02–028
See application file for complete search history.

(56) References Cited

U.S. PATENT DOCUMENTS 5,012,896 A 5/1991 Da Costa
5,222,885 A 6/1993 Cooksey

FOREIGN PATENT DOCUMENTS

CN 1445460 A 10/2003
CN 1626819 A 6/2005
(Continued)

OTHER PUBLICATIONS

International Search Report dated Mar. 26, 2021 received in International Application No. PCT/CN2020/136363 together with an English language translation.
(Continued)

*Primary Examiner* — Laert Dounis
(74) *Attorney, Agent, or Firm* — Scully, Scott, Murphy & Presser, P.C.

(57) ABSTRACT

A compressor and a refrigeration device are provided. The compressor has a shell, a compression assembly, a motor, an oil sump and an oil return channel. The shell defines a cavity. A part of the compression assembly is connected to the shell and located in the cavity. The cavity is divided into a first cavity and a second cavity by the compression assembly. A part of the motor is arranged in the first cavity. A part of the shell located below the central axis of the motor is a first shell. The oil sump is arranged in the second cavity. The oil return channel is arranged in the compression assembly, and is provided with an oil inlet facing the first cavity.

11 Claims, 9 Drawing Sheets

(51) Int. Cl.
*F04C 29/00* (2006.01)
*F25B 31/02* (2006.01)

(52) U.S. Cl.
CPC ..... *F04C 29/02* (2013.01); *F25B 31/026* (2013.01); *F04C 2240/30* (2013.01); *F04C 2240/50* (2013.01); *F04C 2240/805* (2013.01); *F04C 2240/809* (2013.01)

(56) References Cited

FOREIGN PATENT DOCUMENTS

| | | | | | |
|---|---|---|---|---|---|
| CN | 201202646 | Y | | 3/2009 | |
| CN | 201982306 | U | | 9/2011 | |
| CN | 102953999 | A | | 3/2013 | |
| CN | 204003456 | U | | 12/2014 | |
| CN | 106894999 | A | | 6/2017 | |
| CN | 209523874 | U | | 10/2019 | |
| CN | 110513293 | A | | 11/2019 | |
| CN | 209654233 | U | * | 11/2019 | |
| CN | 111828326 | A | | 10/2020 | |
| JP | 2011001922 | A | * | 1/2011 | ..... F04C 18/0215 |

OTHER PUBLICATIONS

First Office Action dated Apr. 2, 2021 received in Chinese Patent Application No. CN 202010613519.2 together with an English language translation.

Second Office Action dated Sep. 3, 2021 received in Chinese Patent Application No. CN 202010613519.2 together with an English language translation.

Supplementary European Search Report dated Jul. 26, 2022 received in European Patent Application No. EP 20937175.6.

Office Action dated Jan. 24, 2024 received in European Patent Application No. EP 20937175.6.

* cited by examiner

COMPRESSOR AND REFRIGERATION DEVICE WITH AN OIL RETURN CHANNEL HAVING A FIRST RELATIVE DISTANCE TO AN INNER-SIDE WALL

CROSS-REFERENCE TO RELATED APPLICATIONS

The present application is a continuation application of PCT International Application No. PCT/CN2020/136363, filed on Dec. 15, 2020, which claims priority to and benefits of Chinese Patent Application No. 202010613519.2 filed with China National Intellectual Property Administration on Jun. 30, 2020 and entitled "Compressor And Refrigeration Device", the entire contents of which are incorporated herein by reference for all purposes. No new matter has been introduced.

FIELD

The present disclosure relates to the technical field of compressing device, and in particular, to a compressor and a refrigeration device.

BACKGROUND

Currently, in the structure of a compressor, a cavity is formed in the enclosed shell of the compressor, the cavity is divided into an oil cavity and a motor cavity by a compression assembly in the compressor. Generally, the circulation of a lubricating oil between the oil cavity and the motor cavity is achieved by disposing an oil return channel in the compression assembly. However, as the working conditions of the operation of the compressor change, the oil level of the lubricating oil on the bottom of the enclosed shell fluctuates significantly. Particularly, in the process that the lubricating oil in the motor cavity is pressurized to the oil cavity under the effect of pressure difference, the lowering of the oil level in the motor cavity may cause the entrance of a part of a refrigerant into the oil cavity through the oil return channel along with the lubricating oil. This renders a low recovery efficiency of the lubricating oil and great fluctuation of the oil level of the oil cavity, and further renders increased oil circulation ratio.

SUMMARY

The present disclosure aims to solve at least one of the technical problems existing in the prior art or related art.

To this end, a first aspect of the present disclosure provides a compressor.

A second aspect of the present disclosure provides a refrigeration device.

According to the first aspect of the present disclosure, a compressor is provided. The compressor comprises a shell, a compression assembly, a motor, an oil sump and an oil return channel. The shell defines a cavity. A part of the compression assembly is fixedly connected to the shell and located in the cavity. The cavity is divided into a first cavity and a second cavity by the compression assembly. A part of the motor is arranged in the first cavity. The oil sump is arranged in the second cavity. The oil return channel is arranged in the compression assembly, and is configured to communicate the first cavity to the second cavity. A part of the shell, which is located below a central axis of the motor, is a first shell. The oil return channel is provided with an oil inlet facing the first cavity, and the oil inlet has a dividing line parallel to a horizontal plane where the central axis of the motor is located. The oil inlet is divided into two areas by the dividing line, the dividing line has two sides, i.e., a side close to the central axis of the motor and a side departing from the central axis of the motor, and an oil through area is located at the side of the dividing line departing from the central axis of the motor. A distance between the dividing line and an inner-side wall of the first shell is a first relative distance, the first relative distance is greater than 0 mm and less than or equal to 12% of an inner diameter of the shell, and an area of the oil through area is greater than or equal to 90% of an area of the oil inlet and less than or equal to the area of the oil inlet.

The compressor provided by the present disclosure comprises a shell, a compression assembly, a motor, an oil sump and an oil return channel. The shell is a sealed shell, and a part of the compression assembly is fixedly connected to the shell. For example, the part of the compression assembly can be fixedly connected to the shell through a welding method, thereby ensuring a reliable connecting performance between the compression assembly and the shell. The compression assembly is arranged in the cavity and divides the cavity into a first cavity and a second cavity. The first cavity is located at the left side of the compression assembly, and the second cavity is located at the right side of the compression assembly. A part of the motor is located in the first cavity, the oil sump is disposed in the second cavity, and a lubricating oil is stored in the oil sump. When the compressor operates, the compression assembly can compress a refrigerant, and a portion of compressed refrigerant air can be exhausted through an exhaust structure provided on the shell, and the other portion of the compressed refrigerant air can enter the first cavity and cool the motor. Subsequently, the refrigerant can enter the second cavity and is exhausted through the exhaust structure. According to the present disclosure, by disposing the oil return channel in the compression assembly, the lubricating oil in the oil sump can communicate through the oil return channel. When the refrigerant enters the first cavity, the pressure in the first cavity rises, and under the effect of the pressure, the lubricating oil in the first cavity can enter the second cavity through the oil return channel. This configuration has a simple and reasonable structure and can improve the recovery efficiency of the lubricating oil, so that the fluctuation of the oil level in the oil sump is relatively stable. In addition, the oil circulation ratio of the compressor is further lowered, so that the oil sump can provide a sufficient volume of oil for the compressor, thereby further improving the reliability and the energy efficiency grade of the compressor. Regardless of the working conditions of the compressor, the oil in the cavity of the motor can return to the oil cavity through the oil return channel in the compression assembly, the oil supply from the oil sump to the compression assembly is ensured, and the reliability of the oil stored in the oil cavity is ensured. As a result, the oil circulation ratio is decreased, and the performance of the compressor is improved.

In addition, the lubricating oil in the oil channel can also enter the interior of the compression assembly to lubricate the compression assembly, and thus the operation of the compressor can be offered more lubrication. For example, the compressor can be a horizontal compressor.

Further, the shell is divided into a first shell and a second shell connected to the first shell, and both the first shell and the second shell extend along the central axis of the motor. When the shell is in a cylindrical shape, both the first shell and the second shell are partial arc segments. The first shell is located under the central axis of the motor. When the horizontal compressor is arranged horizontally on the ground, the outer-side wall of the first shell contacts the ground. The oil return channel has an oil inlet facing the first cavity and an oil outlet facing the second cavity, and the lubricating oil in the first cavity enters the oil return channel through the oil inlet and is discharged to the oil sump through the oil outlet. In the working process of the compressor, the overall pressure in the first cavity is higher than the pressure in the second cavity, and under the effect of a pressure difference, the lubricating oil in the first cavity can be pressurized into the second cavity through the oil return channel. However, when the compressor is in a working condition of a high rotation speed or a low-pressure ratio, the large flow volume in the compressor and the large pressure difference between the two sides of the compression assembly may easily result in the circumstance where the oil level in the first cavity is lower than the oil inlet of the oil return channel. At this moment, under the effect of the pressure difference, the refrigerant can also enter the second cavity through the oil return channel, and form lots of bubbles in the lubricating oil in the oil sump, which results in a violent fluctuation of the oil level in the oil sump, and further renders the increasing of oil circulation ratio of the compressor, so that the performance of the compressor is lowered.

Through lots of experiments and observations, it has been discovered that it is difficult to expose the oil inlet of the oil return channel in the refrigerant when the first relative distance and the inner diameter of the shell meet the above-mentioned relation, and this can effectively improve the ventilation condition in the oil sump, and subsequently lower the oil circulation ratio. Further, the area of the oil through area is greater than or equal to 90% of the area of the oil inlet and less than or equal to the area of the oil inlet, and this can further ensure that the lubricating oil flows from the oil inlet to the oil sump.

When the area of the oil through area is equal to the area of the oil inlet, the dividing line is located at the highest point of the oil inlet (the highest point refers to the highest point in the oil inlet close to the horizontal plane where the central axis of the motor is located). When the area of the oil through area is less than the area of the oil inlet and greater than or equal to 90% of the area of the oil inlet, the dividing line can divide the oil inlet into two areas. One is an oil through area located on the side of the dividing line departing from the central axis of the motor, and the lubricating oil can enter the oil sump through the oil through area.

Further, through lots of experiments and observations, it has been discovered that the distance between the dividing line and the inner-side wall of the first shell is a first relative distance H1, and the oil circulation rate in high frequency (bad) working conditions can be greatly improved when the first relative distance H1 satisfies 0 mm<H1≤10 mm. The ventilation condition of the oil sump can be effectively improved if it is difficult to expose the oil inlet of the oil return channel in the refrigerant, thereby reducing the oil circulation ratio.

It should be explained that, when the dividing line is not located above the first shell, the distance between the dividing line and the inner-side wall of the first shell is the distance between the dividing line and the plane where the inner-side wall of the first shell is located.

For example, the oil return channel is located under the horizontal plane where the central axis of the motor is located, the lubricating oil is deposited on the bottom of the cavity under the effect of gravity, and the oil return channel located in the bottom can help the flow of the lubricating oil.

Further, the oil return channel presents a flaring shape in the direction of the central axis of the motor, and subsequently, the area of the oil outlet is greater than the area of the oil inlet. For example, the oil return channel can also have equivalent cross sections in the direction of the central axis of the motor, and a satisfactory oil circulation rate can be achieved as long as the distance between the oil inlet of the oil return channel and the first shell satisfies the above-mentioned relation.

In another embodiment, the first relative distance is greater than 0 mm and less than or equal to 7 mm.

In the above embodiment, the highest point of the oil inlet in the oil return channel can be further lowered if the first relative distance H1 satisfies 0 mm<H1≤7 mm, so that it is more difficult to expose the oil inlet in the refrigerant, thereby effectively improving the ventilation condition of the oil sump, and further reducing the oil circulation ratio.

In another embodiment, the oil inlet has an apex away from the horizontal plane where the central axis of the motor is located, a distance between the apex and the inner-side wall of the first shell is a second relative distance, and the second relative distance is greater than or equal to 0 mm and less than or equal to 3 mm.

In the above embodiment, the oil inlet has an apex away from the horizontal plane where the central axis of the motor is located, the distance between the apex and the inner-side wall of the first shell is a second relative distance. When the oil inlet is a closed opening, the second relative distance H2 is greater than 0 mm and less than or equal to 3 mm. In other words, the inner-side wall of the compression assembly, which constitutes the oil inlet and the outer-side wall of the compression assembly, are independent from each other, and they do not have any connection relationship. When the oil inlet is a non-closed opening, the second relative distance H2 is equal to 0 mm, and at this moment, the outer-side wall of the compression assembly is connected to the inner-side wall of the compression assembly which constitutes the oil inlet. Based on the conditions that the dividing line and the inner-side wall of the first shell satisfy 0 mm<H1≤10 mm and the distance between the upper apex of the oil inlet and the inner-side wall of the first shell satisfies 0 mm<H2≤3 mm, the dividing line on the oil inlet and the apex (the lowest point in a gravity direction) on the oil inlet are restricted. Therefore, under a precondition of ensuring the flow effect of the lubricating oil, the ventilation condition of the oil sump can be effectively improved if it is difficult to expose the oil inlet of the oil return channel in the refrigerant, and the oil circulation ratio is further reduced.

In another embodiment, a part of the compression assembly is concaved towards a direction close to the central axis of the motor, so as to form the oil return channel.

In the above embodiment, a part of the compression assembly is concaved towards a direction close to the central axis of the motor, so as to form the oil return channel, i.e., the oil return channel has an oil inlet and an oil outlet along the axis of the motor. Meanwhile, the oil return channel also has an opening facing the shell, and subsequently, since the part of the compression assembly which is provided with the oil return channel is fixedly connected to the shell, the second relative distance H2 between the apex on the oil inlet and the inner-side wall of the first shell is 0 mm. Further, a projection of the oil return channel on the cross section of the crankshaft of the motor is in a circular shape, a triangular shape or a polygonal shape.

In another embodiment, the motor comprises a crankshaft, a rotor and a stator. A first end of the crankshaft is located in the first cavity, and a second end of the crankshaft is connected to the compression assembly. The rotor is sleeved on the first end of the crankshaft, the stator is sleeved on the outer-side wall of the rotor, and an interval is formed between at least a part of the outer-side wall of the stator and the inner-side wall of the shell. A sectional area of the interval on a cross section of the crankshaft is a first sectional area, a sectional area of the oil return channel on a cross section of the crankshaft is a second sectional area, and the second sectional area is less than or equal to 30% of the first sectional area.

In the above embodiment, the first end of the crankshaft is located in the first cavity, and adapted and connected to the rotor and the stator of the motor. The second end of the crankshaft is connected to the compression assembly. The rotor is sleeved on the first end of the crankshaft, and the rotor rotates to drive the crankshaft to move, thereby further achieving the moving of the compression assembly. The stator is sleeved on the outer-side wall of the rotor, and an interval is formed between at least a part of the outer-side wall of the stator and the inner-side wall of the shell. The number of the intervals is at least one. The cross section of the crankshaft is a section which is perpendicular to the axial direction of the crankshaft. The sectional area of the intervals on the cross section of the crankshaft is the first sectional area, while the sectional area of the oil return channel on the cross section of the crankshaft is the second sectional area, the second sectional area is less than or equal to 30% of the first sectional area. When the sectional areas of the oil return channel and the intervals on the cross section of the crankshaft satisfy the above relation, the lubricating oil in the first cavity can flow to the oil return channel through the intervals, thereby ensuring the smooth circulation of the lubricating oil in the first cavity, the oil return channel and the second cavity. Thus, the ventilation condition of the oil sump can be improved effectively as it is difficult to expose the oil inlet of the oil return channel in the refrigerant, thereby further reducing the oil circulation ratio.

In another embodiment, the number of the intervals is at least two, and the first sectional area is a sum of the sectional areas of the at least two intervals, the number of the oil return channels is at least two, and the second sectional area is a sum of the sectional areas of the at least two oil return channels.

In the above embodiment, the number of the intervals is multiple, and the first sectional area is a sum of the sectional areas of a plurality of intervals, the number of the oil return channels is multiple, and the second sectional area is a sum of the sectional areas of a plurality of oil return channels. If the sum of the sectional areas of the multiple intervals and the sum of the sectional areas of the multiple oil return channels satisfy the above relation, it can be ensured that the lubricating oil can circulate smoothly in the first cavity, the oil return channel and the second cavity.

In another embodiment, the compression assembly comprises an air cylinder and a main bearing, the main bearing is provided at a side of the air cylinder facing the motor, and a part of the motor penetrates the main bearing and connects the air cylinder. One of the main bearing and the air cylinder, which is fixedly connected to the shell, is a fastener, and the oil return channel is provided on the fastener.

In the above embodiment, the compression assembly comprises an air cylinder and a main bearing, the main bearing is provided at a side of the air cylinder facing the motor, the second end of the crankshaft penetrates the main bearing and connects the air cylinder. The main bearing can be fixedly connected to the inner-side wall of the shell through welding, and the air cylinder can also be fixedly connected to the inner-side wall of the shell through welding, and the fixed connection between the main bearing or the cylinder and the shell can be selected according to actual assembling needs. If the main bearing is welded to the shell, the air cylinder is not fixedly connected to the shell, and at this moment, the oil return channel is disposed on the main bearing, the lubricating oil will enter into the oil return channel through the first cavity, and flow to the oil sump through the gap between the air cylinder and the shell. On the contrary, if the air cylinder is fixedly connected to the shell, the lubricating oil can enter the oil return channel from the first cavity through the gap between the main bearing and the shell, and subsequently enter the oil sump.

In another embodiment, the compressor further comprises an exhaust pipe and an airflow channel. The exhaust pipe is provided on the shell corresponding to the compression assembly, the airflow channel is provided on the compression assembly, and the airflow channel, the first cavity and the exhaust pipe are communicated with each other.

In the above embodiment, when the compressor works, the compression assembly can pressurize the refrigerant, a portion of the compressed refrigerant air can be exhausted directly through the exhaust pipe, the other portion of the compressed refrigerant air can enter the first cavity through the airflow channel and cool the motor, and subsequently, the refrigerant can enter the second cavity and is exhausted through the exhaust pipe.

In another embodiment, the compressor further comprises a base and a mounting rack, and the mounting rack is connected to a side of the base facing the shell, and the mounting rack is adapted and connected to the shell.

In the above embodiment, the base can be parallel to the crankshaft, i.e., the shell is disposed on the base horizontally. The base can also be disposed at a certain angle with the crankshaft, i.e., the shell is tilted on the base. When the shell is disposed on the base, the central axis of the motor has a horizontal plane where it is located. When the shell is tilted on the base, the central axis is at a certain angle with respect to the horizontal plane, and subsequently, the base can be tilted fixedly on the horizontal bottom, so that the central axis (crankshaft) of the motor is parallel to the horizontal plane, and subsequently the position relation between the oil inlet in the compression assembly of the compressor and the first shell should also satisfy the above relation.

According to the second aspect of the present disclosure, a refrigeration device is provided, and the refrigeration device comprises a compressor provided according to any one of the above embodiments.

The refrigeration device provided by the present disclosure comprises the compressor provided according to any one of the above embodiments, and thus has all the beneficial effects of the compressor, which will not be repeated herein.

Further, the refrigeration device further comprises a housing, a mounting cavity is formed in the housing, the compressor is connected to the housing and located in the mounting cavity, and the compressor, through the protection of the housing, will not be affected by external environment, thereby ensuring the accurate operation of the compressor.

Additional aspects and advantages of the present disclosure will be apparent from the following description, or may be learned by practice of the present disclosure.

BRIEF DESCRIPTION OF THE DRAWINGS

The above and/or additional aspects and advantages of the present disclosure will become obvious and easy to understand from the description of the embodiments in conjunction with the following drawings, wherein.

Figure 1:
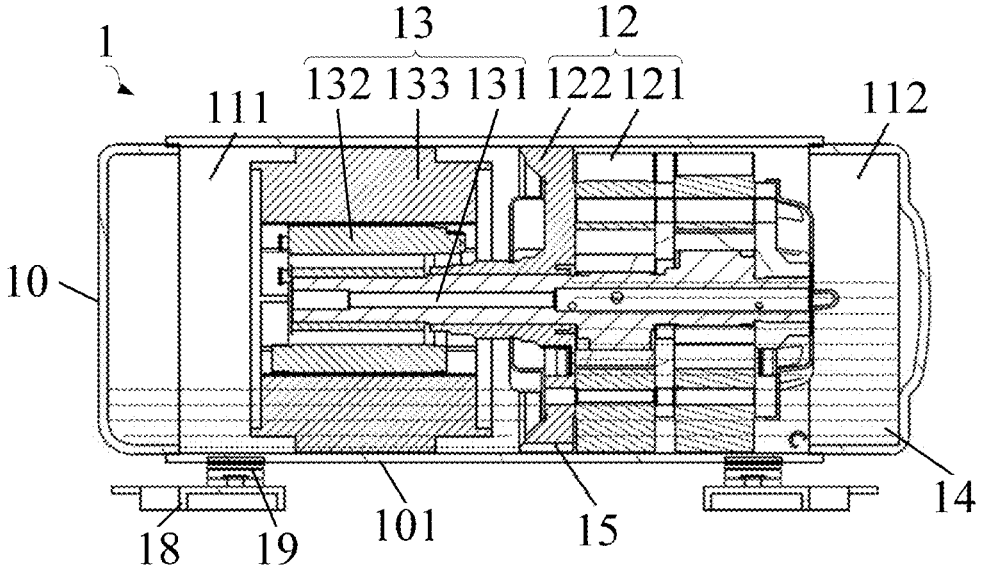
FIG. 1 is a sectional view of the structure of a compressor according to an embodiment of the present disclosure.

The description of the reference numerals shown in FIGS. 1 to 8 is provided as follows:

1 compressor, 10 shell, 101 first shell, 11 cavity, 111 first cavity, 112 second cavity, 12 compression assembly, 121 air cylinder, 122 main bearing, 13 motor, 131 crankshaft, 132 rotor, 133 stator, 134 interval, 14 oil sump, 15 oil return channel, 151 oil inlet, 16 exhaust pipe, 17 airflow channel, 18 base, 19 mounting rack.

DETAILED DESCRIPTION OF EMBODIMENTS

In order that the above objects, features, and advantages of the present disclosure may be more clearly understood, the present disclosure will be described in further detail with reference to the accompanying drawings and preferred embodiments. It should be noted that the embodiments and features in the embodiments of the present disclosure may be combined with one another without conflict.

In the following description, many specific details are set forth in order to fully understand the present disclosure. However, the present disclosure can also be implemented in other ways different from those described herein. Therefore, the scope of the present disclosure is not limited by specific embodiments disclosed below.

A compressor 1 and a refrigeration device according to some embodiments of the present disclosure are described below with reference to FIGS. 1-10.

Figure 2:
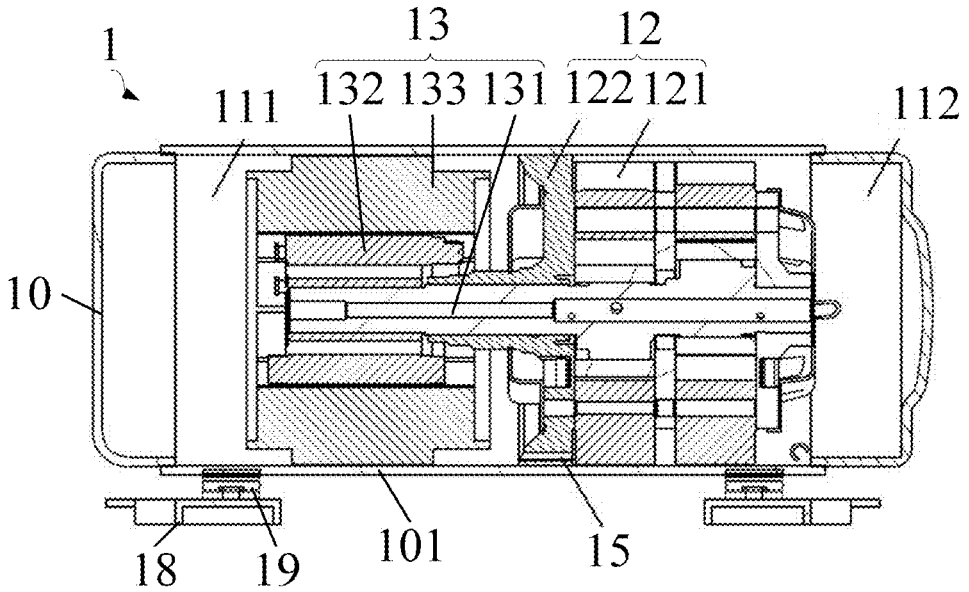
FIG. 2 is a sectional view of the structure of a compressor according to another embodiment of the present disclosure.

According to an exemplary embodiment of the present disclosure, a compressor 1 is provided. As shown in FIGS. 1 and 2, and the compressor 1 comprises a shell 10, a compression assembly 12, a motor 13, an oil sump 14 and an oil return channel 15. The shell 10 defines a cavity 11. A part of the compression assembly 12 is fixedly connected to the shell 10 and located in the cavity 11, and the cavity 11 is divided into a first cavity 111 and a second cavity 112 by the compression assembly 12. A part of the motor 13 is arranged in the first cavity 111, and the oil sump 14 is arranged in the second cavity 112. The oil return channel 15 is arranged in the compression assembly 12, and is configured to communicate the first cavity 111 and the second cavity 112. The part of the shell 10 located below a central axis of the motor 13 is a first shell 101, the oil return channel 15 is provided with an oil inlet 151 facing the first cavity 111, and the oil inlet 151 has a dividing line parallel to a horizontal plane where the central axis of the motor 13 is located. The oil inlet is divided into two areas by the dividing line, the dividing line has two sides, i.e., a side close to the central axis of the motor 13 and a side departing from the central axis of the motor 13, and an oil through area is located at the side of the dividing line departing from the central axis of the motor 13. A distance between the dividing line and an inner-side wall of the first shell 101 is a first relative distance, the first relative distance is greater than 0 mm and less than or equal to 12% of an inner diameter of the shell 10, and an area of the oil through area is greater than or equal to 90% of an area of the oil inlet 151 and less than or equal to the area of the oil inlet 151.

The compressor 1 provided by the present disclosure comprises a shell 10, a compression assembly 12, a motor 13, an oil sump 14 and an oil return channel 15. The shell 10 is a sealed shell 10, and a part of the compression assembly 12 is fixedly connected to the shell 10. For example, a part of the compression assembly 12 can be fixedly connected to the shell 10 through a welding method, thereby ensuring a reliable connecting performance between the compression assembly 12 and the shell 10. The compression assembly 12 is arranged in the cavity 11 and divides the cavity 11 into a first cavity 111 and a second cavity 112. The first cavity 111 is located at the left side of the compression assembly 12, and the second cavity 112 is located at the right side of the compression assembly 12. A part of the motor 13 is located in the first cavity 111, the oil sump 14 is disposed in the second cavity 112, and a lubricating oil is stored in the oil sump 14. When the compressor 1 works, the compression assembly 12 can compress a refrigerant, and a portion of compressed refrigerant air can be exhausted through an exhaust structure provided on the shell 10, and the other portion of the compressed refrigerant air can enter the first cavity 111 and cool the motor 13, and subsequently, the refrigerant can enter the second cavity 112 and is exhausted through the exhaust structure. According to the present disclosure, through disposing the oil return channel 15 in the compression assembly 12, the lubricating oil in the oil sump 14 can communicate through the oil return channel 15. When the refrigerant enters the first cavity 111, the pressure in the first cavity 111 rises, and under the effect of the pressure, the lubricating oil in the first cavity 111 can enter the second cavity 112 through the oil return channel 15. This embodiment has a simple and reasonable structure and can improve the recovery efficiency of the lubricating oil, so that the fluctuation of the oil level in the oil sump 14 is relatively stable, and the oil circulation ratio of the compressor 1 is further lowered, so that the oil sump 14 can provide a sufficient volume of oil for the compressor 1, thereby further improving the reliability and the energy efficiency grade of the compressor 1. Regardless of the working conditions of the compressor 1, the oil in the cavity of the motor 13 can return to the oil cavity through the oil return channel 15 in the compression assembly 12, the oil supply from the oil sump 14 to the compression assembly is ensured, and the reliability of the oil stored in the oil cavity is ensured. Therefore, the oil circulation ratio is decreased, and the performance of the compressor 1 is improved.

In addition, the lubricating oil in the oil return channel 15 can also enter the interior of the compression assembly 12 to lubricate the compression assembly 12, and thus the operation of the compressor 1 can be offered more lubrication. For example, the compressor 1 can be a horizontal compressor.

Figure 3:
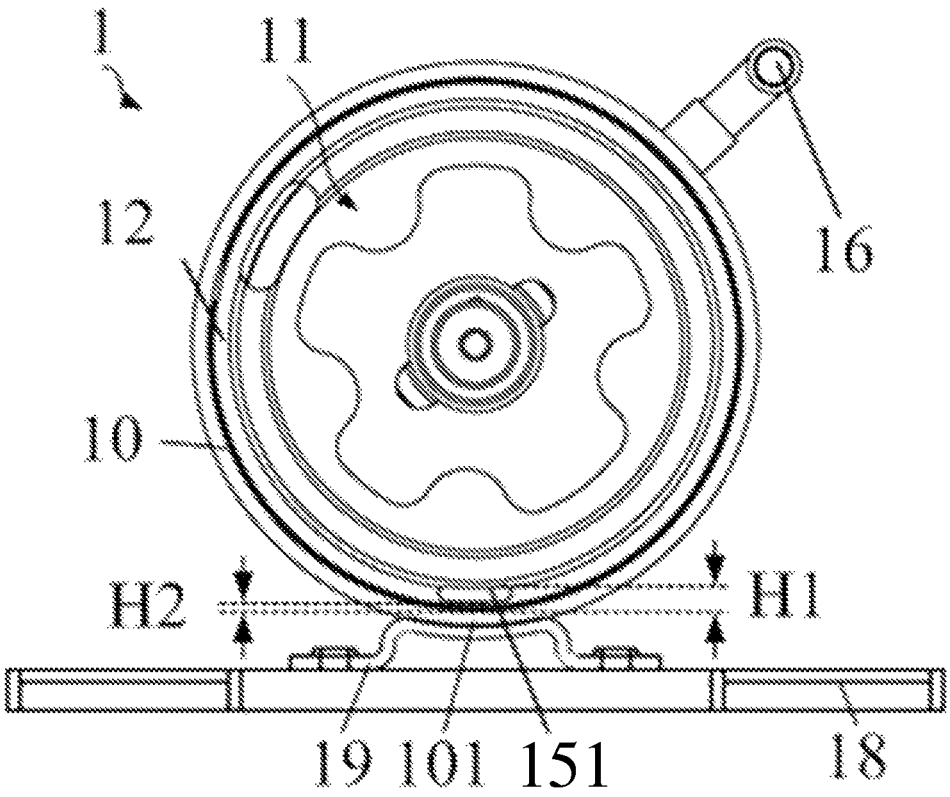
FIG. 3 is a schematic view of the structure of a compressor according to an embodiment of the present disclosure.

Further, as shown in FIG. 3, the shell 10 is divided into a first shell 101 and a second shell 10 connected to the first shell 101, and both the first shell 101 and the second shell 10 extend along the central axis of the motor 13. When the shell 10 is in a cylindrical shape, both the first shell 101 and the second shell 10 are partial arc segments. The first shell 101 is located under the central axis of the motor 13. When the horizontal compressor is arranged horizontally on the ground, the outer-side wall of the first shell 101 contacts the ground. The oil return channel 15 has an oil inlet 151 facing the first cavity 111 and an oil outlet facing the second cavity 112, and the lubricating oil in the first cavity 111 enters the oil return channel 15 through the oil inlet 151 and is discharged to the oil sump 14 through the oil outlet. In the working process of the compressor 1, the overall pressure in the first cavity 111 is higher than the pressure in the second cavity 112, and under the effect of a pressure difference, the lubricating oil in the first cavity 111 can be pressurized into the second cavity 112 through the oil return channel 15. However, when the compressor 1 is in a working condition of a high rotation speed or a low-pressure ratio, the large flow volume in the compressor 1 and the large pressure difference between the two sides of the compression assembly 12 may easily render the circumstance that the oil level in the first cavity 111 is lower than the oil inlet 151 of the oil return channel. At this moment, under the effect of the pressure difference, the refrigerant can also enter the second cavity 112 through the oil return channel 15, and form lots of bubbles in the lubricating oil in the oil sump 14, which results in a violent fluctuation of the oil level in the oil sump 14, and further renders the increasing of oil circulation ratio of the compressor 1, so that the performance of the compressor 1 is lowered.

Figure 9:
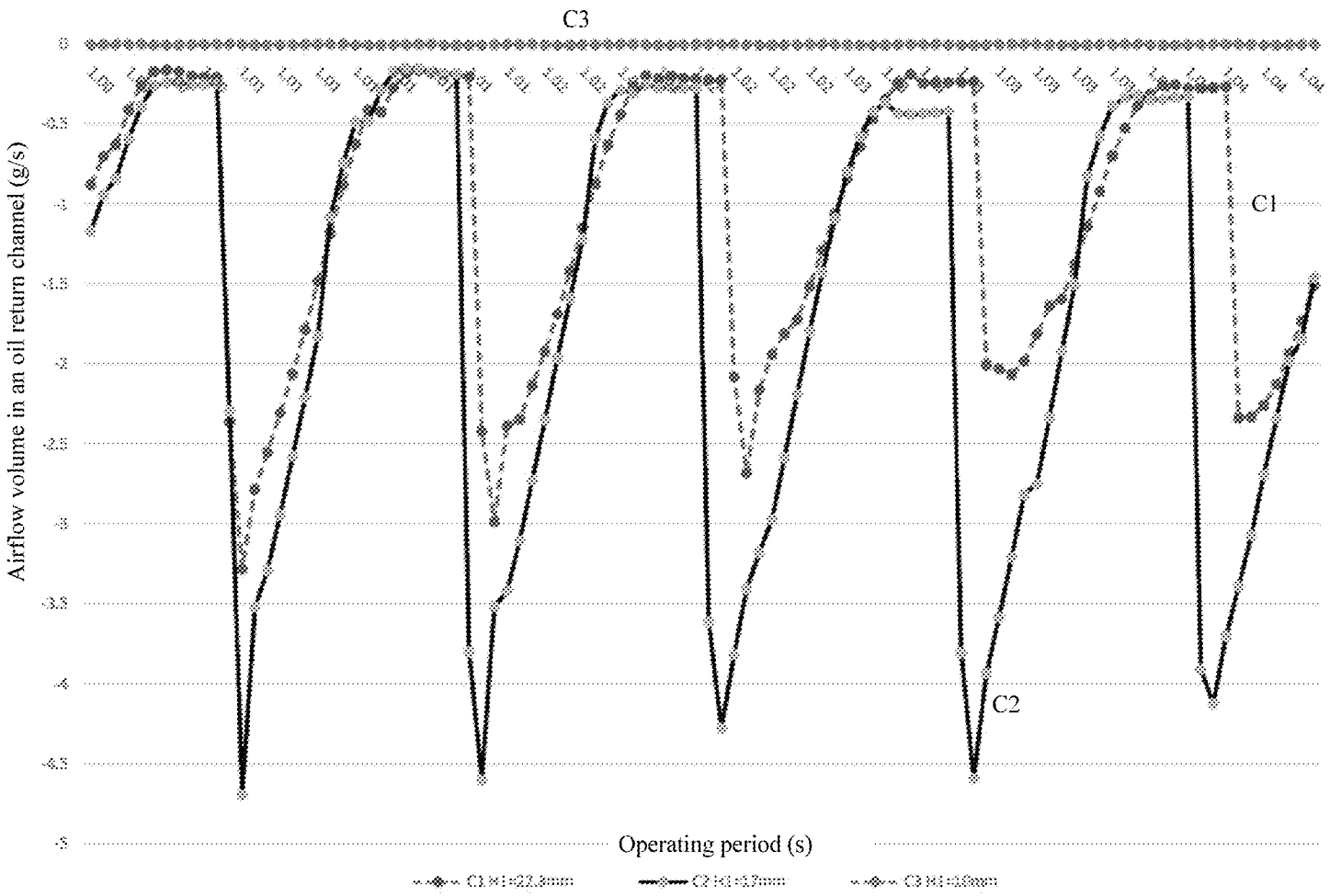
FIG. 9 is a view of a simulation curve of the airflow volume in an oil return channel in a compressor according to an embodiment of the present disclosure.
Figure 10:
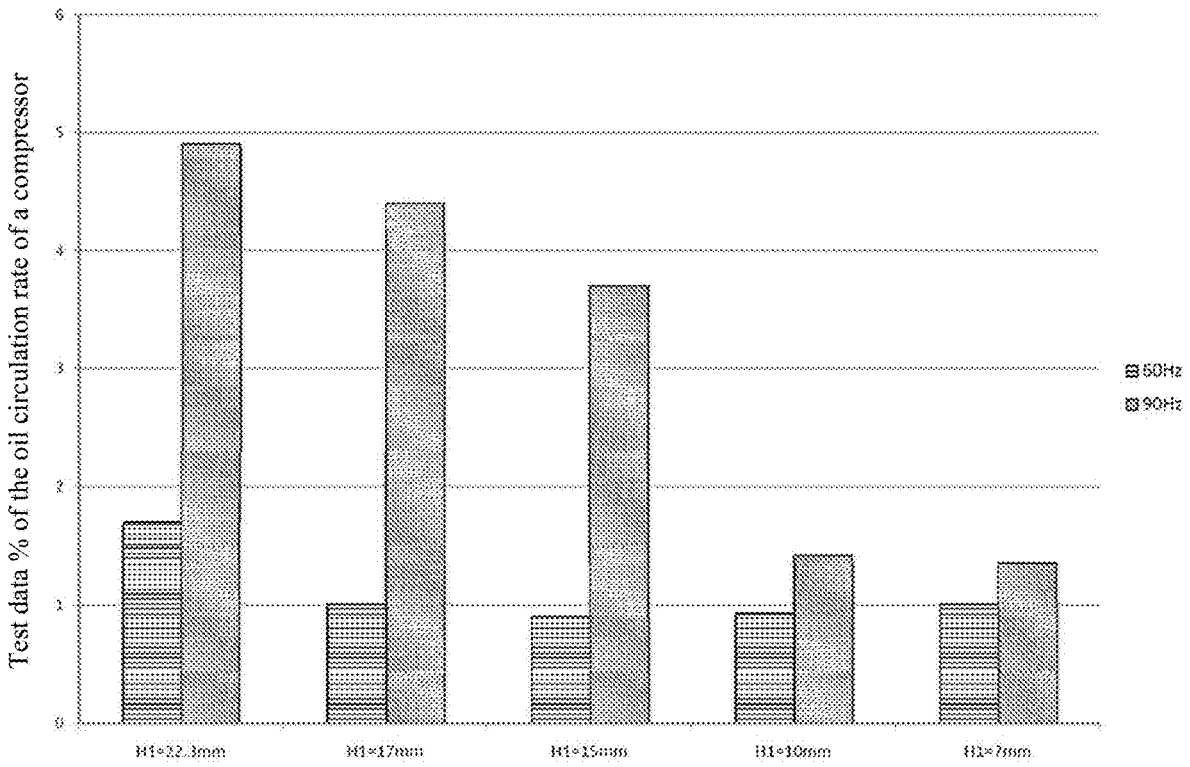
FIG. 10 is a histogram of test data of the oil circulation rate of a compressor according to an embodiment of the present disclosure.

As shown in FIGS. 9 and 10, through lots of experiments and observations, it has been discovered that the distance between the dividing line and the inner-side wall of the first shell 101 is a first relative distance H1, and the oil circulation rate in high frequency (bad) working conditions can be greatly improved when the first relative distance H1 satisfies 0 mm<H1≤10 mm. The ventilation condition of the oil sump 14 can be effectively improved if it is difficult to expose the oil inlet 151 of the oil return channel 15 in the refrigerant, thereby reducing the oil circulation ratio.

For example, as shown in FIG. 9, in a simulation experiment, the distance H1 between the dividing line in the oil inlet 151 and the inner-side wall of the first shell 101 of the compressor 1 is set as a variable, and thus three groups of comparative experiments are formed, while the other operating parameters of the compressor 1 are the same, and the operating parameters of the compressor 1, for example, comprise a suction temperature of −1° C., a suction pressure of 0.38 MPa, an exhaust temperature of 70° C., an exhaust pressure of 1.53 MPa, and a rotating speed of 60 Hz. When H1=22.3 mm, referring to curve C1, it can be seen that the airflow volume (i.e., the air flow of the refrigerant air) in the oil return channel 15 presents a regular fluctuation within a certain operating period, that is, at this moment, the refrigerant air exists in the oil return channel 15, which will affect the stability of the oil level of the lubricating oil in the oil sump 14. When the first relative distance H1 is reduced to 17 mm, referring to curve C2, it can be seen that a portion of the refrigerant air exists in the oil return channel 15. However, when the first relative distance H1=10 mm, at this moment, referring to curve C3, it can be seen that the airflow volume in the oil return channel 15 tends to be 0, that is, when the distance between the dividing line of the oil inlet 151 of the oil return channel 15 and the inner-side wall of the first shell 101 satisfies 0 mm<H1≤10 mm, it is difficult to expose the oil inlet 151 of the oil return channel 15 in the refrigerant, thereby effectively improving the ventilation condition of the oil sump 14, and further reducing the oil circulation ratio, and greatly improving the oil circulation rate in high frequency (bad) working conditions.

Referring to FIG. 10, it can be seen that, when the operation frequency of the compressor 1 is 60 Hz, the distance H1 between the dividing line of the oil inlet 151 of the oil return channel 15 and the inner-side wall of the first shell 101 is reduced, and subsequently the oil circulation rate of the compressor 1 can be reduced slightly. When the operation frequency of the compressor 1 is 90 Hz, and when the H1 is reduced, it can be found that the oil circulation rate of the compressor 1 is reduced greatly. When H1=22.3 mm, the oil circulation rate of the compressor 1 is 4.9, when H1=10 mm, the oil circulation rate of the compressor 1 is reduced to 1.42, and therefore, reducing the distance H1 between the dividing line of the oil inlet 151 of the oil return channel 15 and the inner-side wall of the first shell 101 can greatly improve the oil circulation rate of the compressor 1 in high frequency (bad) working conditions.

When the first relative distance H1 and the inner diameter of the shell 10 satisfy the abovementioned relation, it is difficult to expose the oil inlet 151 of the oil return channel 15 in the refrigerant, and this can effectively improve the ventilation condition in the oil sump 14, and subsequently lower the oil circulation ratio of the compressor. Further, the area of the oil through area is greater than or equal to 90% of the area of the oil inlet 151 and less than or equal to the area of the oil inlet 151, and this can further ensure that the lubricating oil flows from the oil inlet 151 to the oil sump 14.

When the area of the oil through area is equal to the area of the oil inlet 151, the dividing line is located at the highest point of the oil inlet 151 (the highest point refers to the highest point in the oil inlet 151 close to the horizontal plane where the central axis of the motor 13 is located). When the area of the oil through area is less than the area of the oil inlet 151 and greater than or equal to 90% of the area of the oil inlet 151, the dividing line can divide the oil inlet 151 into two areas. One is an oil through area located on the side of the dividing line departing from the central axis of the motor, and the lubricating oil can enter the oil sump 14 through the oil through area.

It should be explained that, when the dividing line is not located above the first shell 101, the distance between the dividing line and the inner-side wall of the first shell 101 is the distance between the dividing line and the plane where the inner-side wall of the first shell 101 is located.

For example, the oil return channel 15 is located under the horizontal plane where the central axis of the motor 13 is located, the lubricating oil is deposited on the bottom of the cavity 11 under the effect of gravity, and the oil return channel 15 located in the bottom can help the flow of the lubricating oil.

Further, the oil return channel 15 presents a flaring shape in the direction of the central axis of the motor 13, and subsequently, the area of the oil outlet is greater than the area of the oil inlet 151. For example, the oil return channel 15 can also have equivalent cross sections in the direction of the central axis of the motor 13, and a good oil circulation rate can be achieved as long as the distance between the oil inlet 151 of the oil return channel 15 and the first shell 101 satisfies the abovementioned relation.

Further, the first relative distance is greater than 0 mm and less than or equal to 7 mm.

In the embodiment, the highest point of the oil inlet 151 in the oil return channel 15 can be further lowered if the first relative distance H1 satisfies 0 mm<H1≤7 mm, so that it is more difficult to expose the oil inlet 151 in the refrigerant, thereby effectively improving the ventilation condition of the oil sump 14, and further reducing the oil circulation ratio.

Further, as shown in FIG. 3, the oil inlet 151 has an apex away from the horizontal plane where the central axis of the motor 13 is located, a distance between the apex and the inner-side wall of the first shell 101 is a second relative distance, and the second relative distance is greater than or equal to 0 mm and less than or equal to 3 mm.

Figure 4:
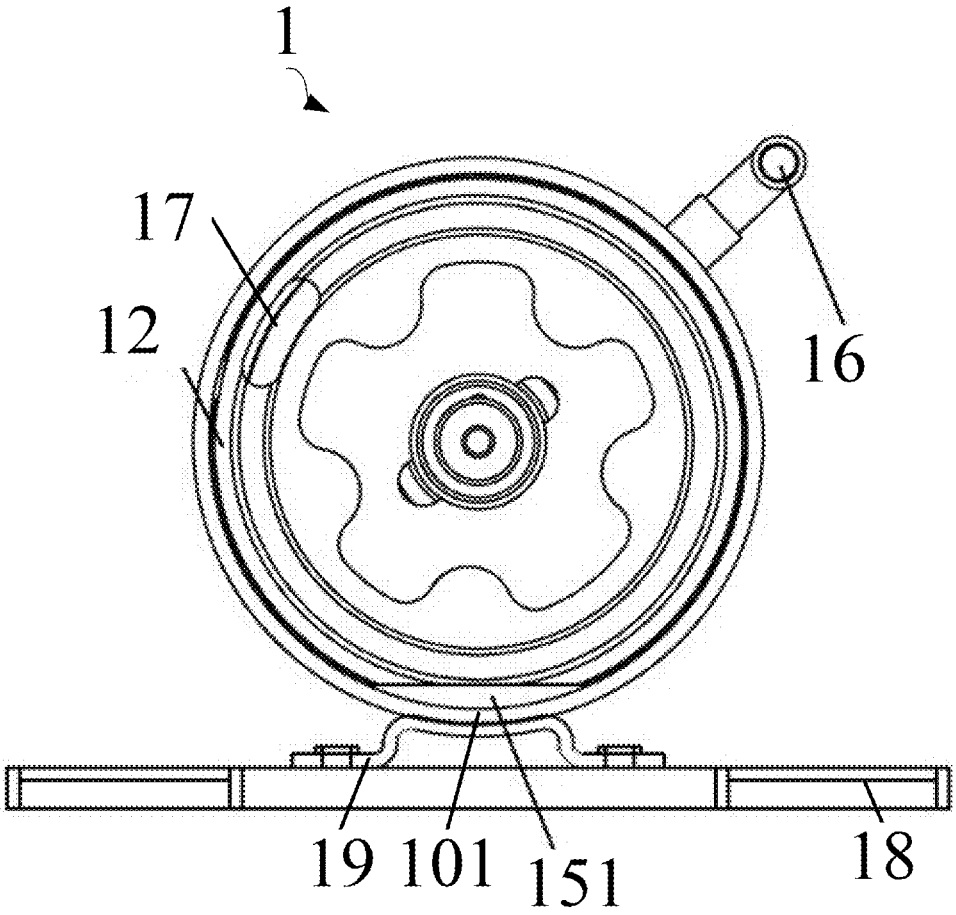
FIG. 4 is a schematic view of the structure of a compressor according to another embodiment of the present disclosure.
Figure 5:
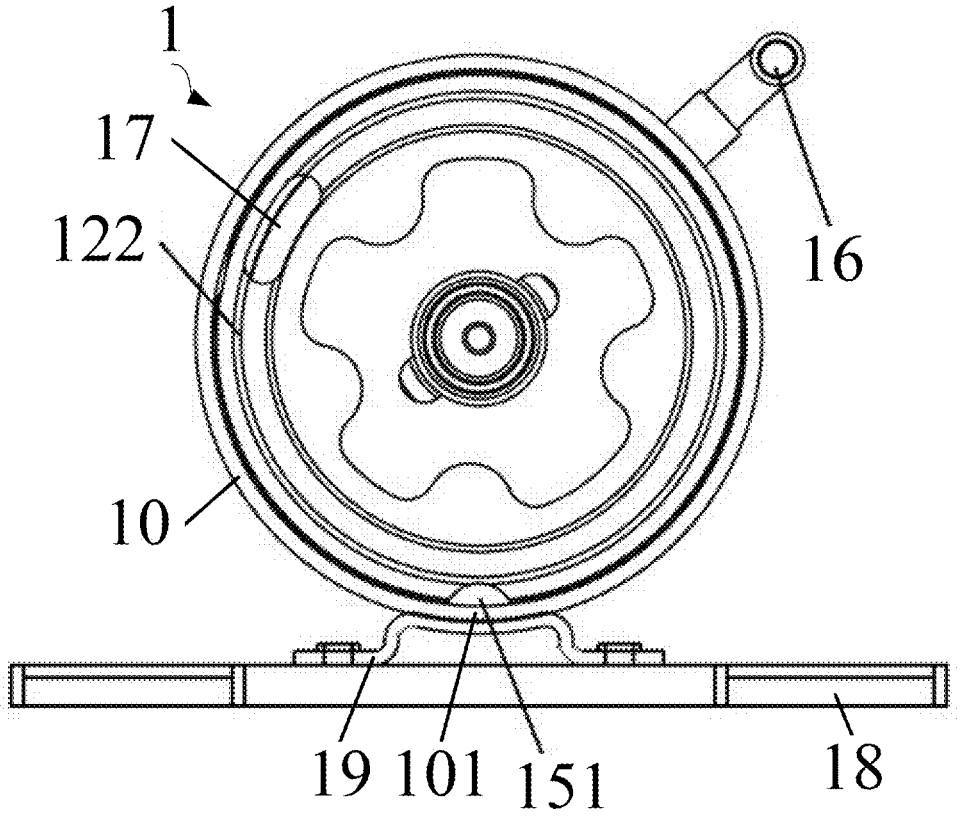
FIG. 5 is a schematic view of the structure of a compressor according to another embodiment of the present disclosure.
Figure 6:
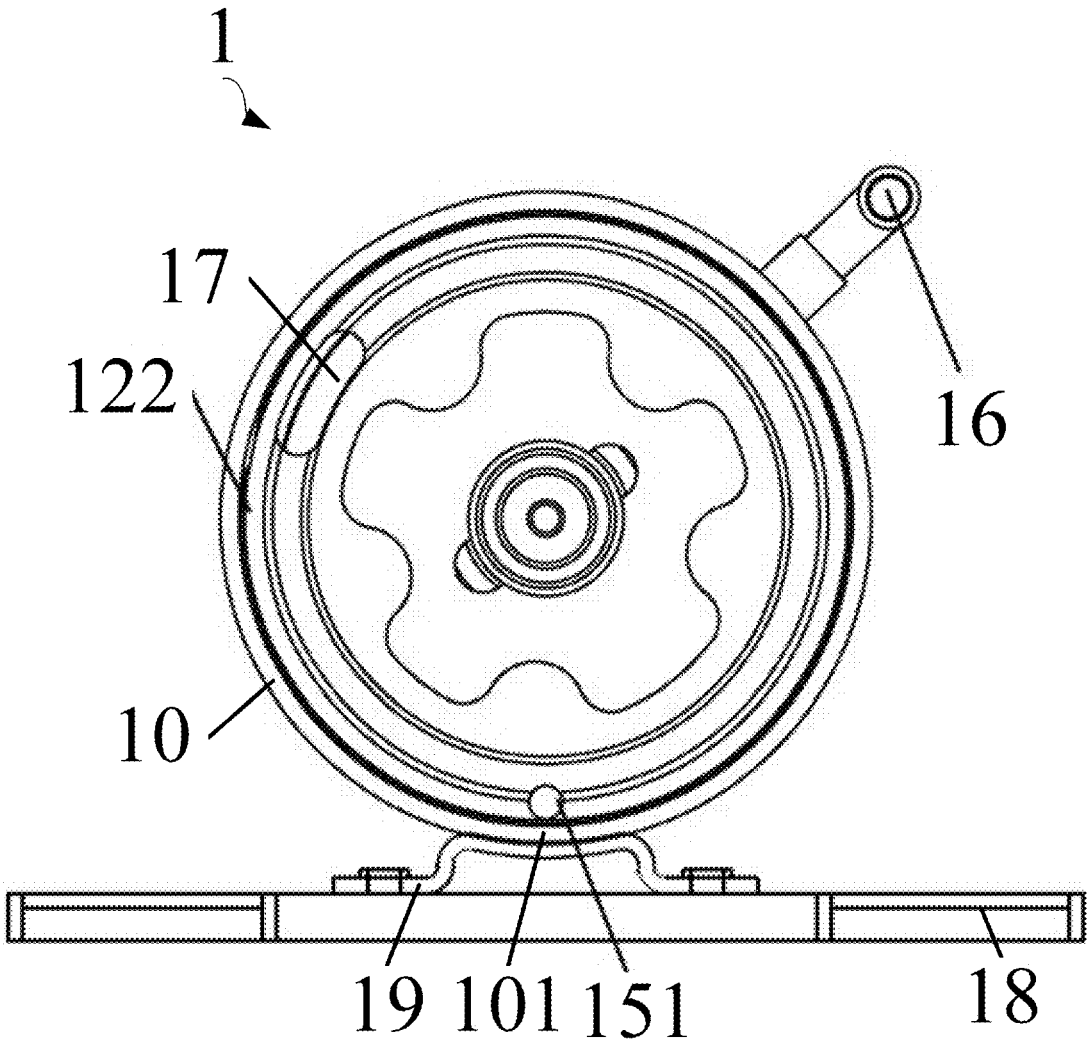
FIG. 6 is a schematic view of the structure of a compressor according to another embodiment of the present disclosure.
Figure 7:
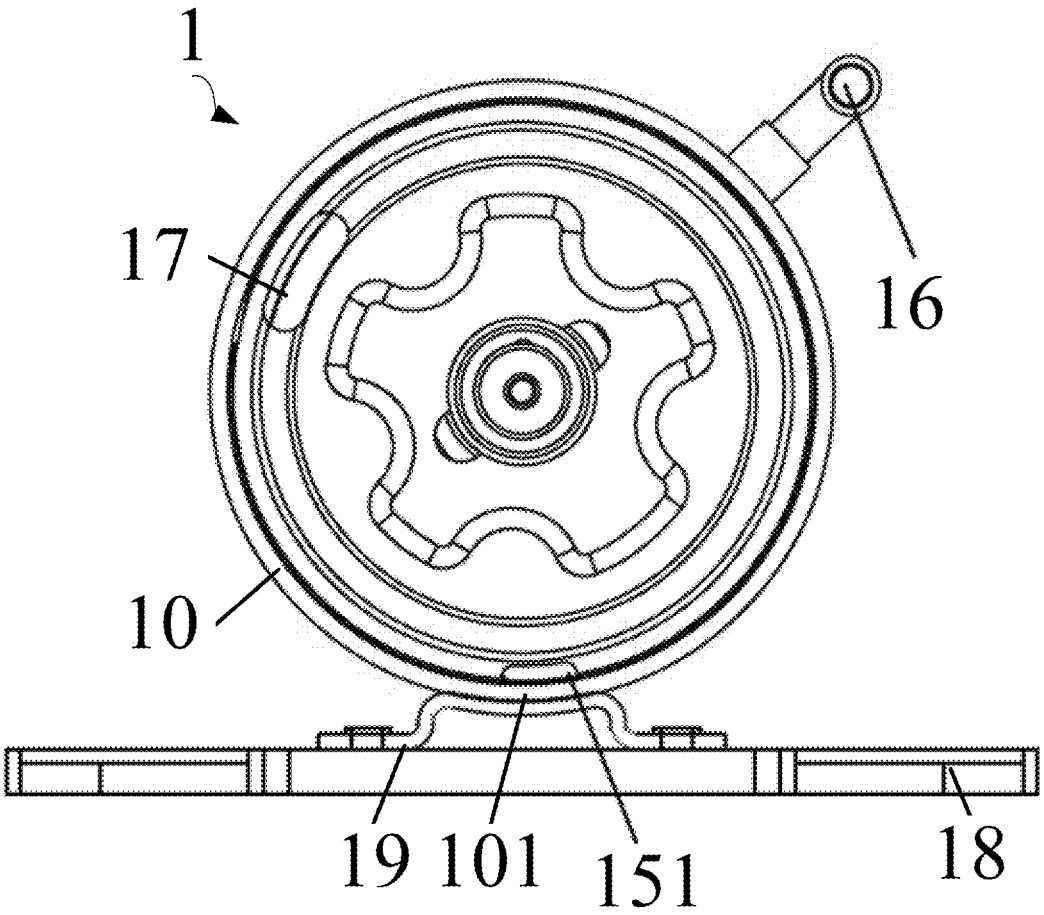
FIG. 7 is a schematic view of the structure of a compressor according to another embodiment of the present disclosure.

In the embodiment, as shown in FIGS. 4 and 5, the oil inlet 151 has an apex away from the horizontal plane where the central axis of the motor 13 is located, the distance between the apex and the inner-side wall of the first shell 101 is a second relative distance. When the oil inlet 151 is a closed opening, as shown in FIGS. 6 and 7, the second relative distance H2 is greater than 0 mm and less than or equal to 3 mm, that is, the inner-side wall of the compression assembly 12 which constitutes the oil inlet 151 and the outer-side wall of the compression assembly 12 are independent from each other, and they do not have any connection relation. When the oil inlet 151 is a non-closed opening, as shown in FIGS. 4 and 5, the second relative distance H2 is equal to 0 mm, and at this moment, the outer-side wall of the compression assembly 12 is connected to the inner-side wall of the compression assembly 12 which constitutes the oil inlet 151. Based on the conditions that the dividing line and the inner-side wall of the first shell 101 satisfy 0 mm<H1≤10 mm, and the distance between the upper apex of the oil inlet 151 and the inner-side wall of the first shell 101 satisfies 0 mm<H2≤3 mm, the dividing line on the oil inlet 151 and the apex (the lowest point in a gravity direction) on the oil inlet 151 are restricted, and therefore, in a precondition of ensuring the flow effect of the lubricating oil, so that the ventilation condition of the oil sump 14 can be effectively improved as it is difficult to expose the oil inlet 151 of the oil return channel 15 in the refrigerant, and the oil circulation ratio is further reduced.

Further, a part of the compression assembly 12 is concaved towards a direction close to the central axis of the motor 13, so as to form the oil return channel 15.

In the embodiment, a part of the compression assembly 12 is concaved towards a direction close to the central axis of the motor 13, so as to form the oil return channel 15, i.e., the oil return channel 15 has an oil inlet 151 and an oil outlet along the axis of the motor 13. Meanwhile, the oil return channel 15 also has an opening facing the shell 10, and subsequently, since the part of the compression assembly 12 which is provided with the oil return channel 15 is fixedly connected to the shell 10, the second relative distance H2 between the apex on the oil inlet 151 and the inner-side wall of the first shell 101 is 0 mm. Further, a projection of the oil return channel 15 on the cross section of the crankshaft 131 of the motor 13 is in a circular shape, a triangular shape or a polygonal shape.

According to another exemplary embodiment, the motor 13 comprises a crankshaft 131, a rotor 132 and a stator 133. A first end of the crankshaft 131 is located in the first cavity 111, and a second end of the crankshaft 131 is connected to the compression assembly 12. The rotor 132 is sleeved on the first end of the crankshaft 131, the stator 133 is sleeved on an outer-side wall of the rotor 132, and an interval 134 is formed between at least a part of an outer-side wall of the stator 133 and the inner-side wall of the shell 10. A sectional area of the interval 134 on a cross section of the crankshaft 131 is a first sectional area, a sectional area of the oil return channel 15 on a cross section of the crankshaft 131 is a second sectional area, and the second sectional area is less than or equal to 30% of the first sectional area.

Figure 8:
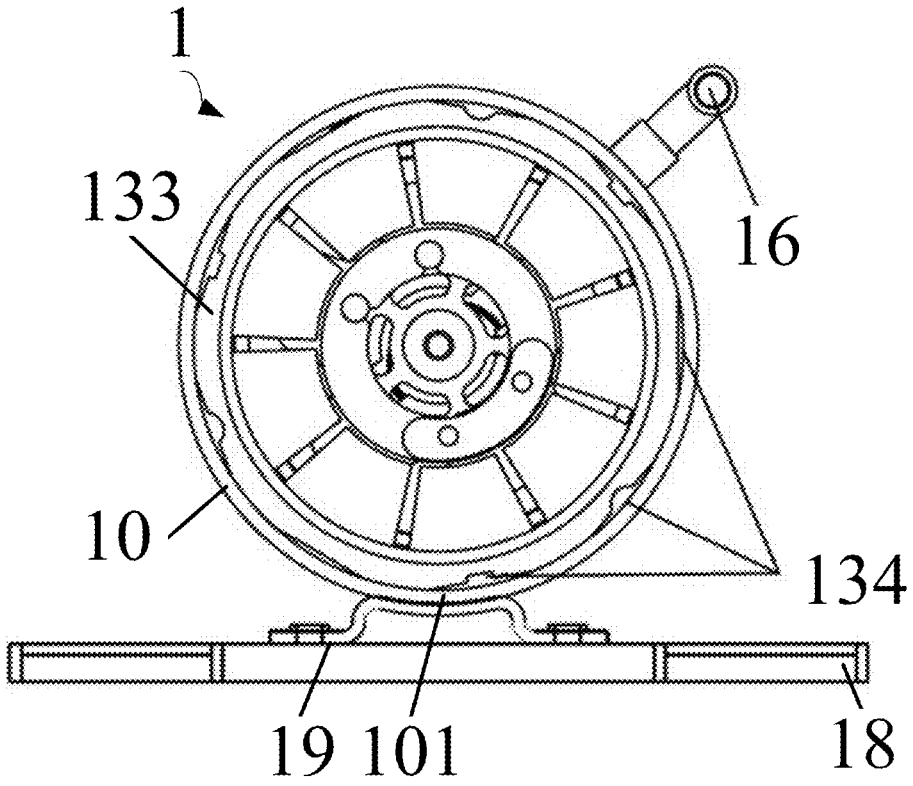
FIG. 8 is a schematic view of the structure of a compressor according to another embodiment of the present disclosure.

In the embodiment, as shown in FIG. 8, the first end of the crankshaft 131 is located in the first cavity 111, and adapted and connected to the rotor 132 and the stator 133 of the motor 13. The second end of the crankshaft 131 is connected to the compression assembly 12, the rotor 132 is sleeved on the first end of the crankshaft 131, and the rotor 132 rotates to drive the crankshaft 131 to move, thereby further achieving the moving of the compression assembly 12. The stator 133 is sleeved on an outer-side wall of the rotor 132, and an interval 134 is formed between at least a part of an outer-side wall of the stator 133 and the inner-side wall of the shell 10. The number of the intervals 134 is at least one. The cross section of the crankshaft 131 is a section which is perpendicular to the axial direction of the crankshaft 131. The sectional area of the intervals 134 on the cross section of the crankshaft 131 is the first sectional area, while the sectional area of the oil return channel 15 on the cross section of the crankshaft 131 is the second sectional area, the second sectional area is less than or equal to 30% of the first sectional area. When the sectional areas of the oil return channel 15 and the intervals 134 on the cross section of the crankshaft 131 satisfy the above relation, the lubricating oil in the first cavity 111 can flow to the oil return channel 15 through the intervals 134, thereby ensuring the smooth circulation of the lubricating oil in the first cavity 111, the oil return channel 15 and the second cavity 112, and thus the ventilation condition of the oil sump can be improved effectively as it is difficult to expose the oil inlet 151 of the oil return channel 15 in the refrigerant, thereby further reducing the oil circulation ratio.

Further, the number of the intervals 134 is at least two, and the first sectional area is a sum of the sectional areas of the at least two intervals 134, the number of the oil return channels 15 is at least two, and the second sectional area is a sum of the sectional areas of the at least two oil return channels 15.

In the embodiment, the number of the intervals 134 is multiple, and the first sectional area is a sum of the sectional areas of a plurality of intervals 134, the number of the oil return channels 15 is multiple, and the second sectional area is a sum of the sectional areas of a plurality of oil return channels 15. If the sum of the sectional areas of the multiple intervals 134 and the sum of the sectional areas of the multiple oil return channels 15 satisfy the above relation, it can be ensured that the lubricating oil can circulate smoothly in the first cavity 111, the oil return channel 15 and the second cavity 112.

According to another exemplary embodiment of the present disclosure, the compression assembly 12 comprises an air cylinder 121 and a main bearing 122. The main bearing 122 is provided at a side of the air cylinder 121 facing the motor 13, and a part of the motor 13 penetrates the main bearing 122 and connects the air cylinder 121. One of the main bearing 122 and the air cylinder 121, which is fixedly connected to the shell 10, is a fastener, and the oil return channel 15 is provided on the fastener.

In the embodiment, the compression assembly 12 comprises an air cylinder 121 and a main bearing 122. The main bearing 122 is provided at a side of the air cylinder 121 facing the motor 13, the second end of the crankshaft 131 penetrates the main bearing 122 and connects the air cylinder 121. The main bearing 122 can be fixedly connected to the inner-side wall of the shell 10 through welding, and the air cylinder 121 can also be fixedly connected to the inner-side wall of the shell 10 through welding, and the fixed connection between the main bearing 122 or the cylinder 121 and the shell 10 can be selected according to actual assembling needs. If the main bearing 122 is welded to the shell 10, the air cylinder 121 is not fixedly connected to the shell 10, and at this moment, the oil return channel 15 is disposed on the main bearing 122, the lubricating oil will enter into the oil return channel 15 from the first cavity 111 through the oil inlet 151, and flow to the oil sump 14 through the gap between the air cylinder 121 and the shell 10. On the contrary, if the air cylinder 121 is fixedly connected to the shell 10, the lubricating oil can enter the oil return channel 15 from the first cavity 111 through the gap between the main bearing 122 and the shell 10, and subsequently enter the oil sump 14.

Further, the compressor 1 further comprises an exhaust pipe 16 and an airflow channel 17. The exhaust pipe 16 is provided on the shell 10 corresponding to the compression assembly 12, the airflow channel 17 is provided on the compression assembly 12, and the airflow channel 17, the first cavity 111 and the exhaust pipe 16 are communicated with each other.

In the embodiment, when the compressor 1 works, the compression assembly 12 can pressurize the refrigerant, a portion of the compressed refrigerant air can be exhausted directly through the exhaust pipe 16, the other portion of the compressed refrigerant air can enter the first cavity 111 through the airflow channel 17 and cool the motor 13, and subsequently, the refrigerant can enter the second cavity 112 and is exhausted through the exhaust pipe 16.

Further, the compressor 1 further comprises a base 18 and a mounting rack 19, and the mounting rack 19 is connected to a side of the base 18 facing the shell 10, and the mounting rack 19 is adapted and connected to the shell 10.

In the embodiment, the base 18 can be parallel to the crankshaft 131, i.e., the shell 10 is disposed on the base 18 horizontally. The base 18 can also be disposed at a certain angle with the crankshaft 131, i.e., the shell 10 is tilted on the base 18. When the shell 10 is disposed on the base 18, the central axis of the motor 10 has a horizontal plane where it is located. When the shell 10 is tilted on the base 18, the central axis is at a certain angle with respect to the horizontal plane, and subsequently, the base 18 can be tilted fixedly on the horizontal bottom, so that the central axis (crankshaft 131) of the motor 13 is parallel to the horizontal plane, and subsequently the position relation between the oil inlet 151 in the compression assembly 12 of the compressor 1 and the first shell 101 should also satisfy the above relation.

According to another exemplary embodiment of the present disclosure, a refrigeration device is provided, and the refrigeration device comprises a compressor 1 provided according to any one of the above embodiments.

The refrigeration device provided by the present disclosure comprises the compressor 1 provided according to any one of the above embodiments, and thus has all the beneficial effects of the compressor, which will not be repeated herein.

Further, the refrigeration device further comprises a housing, a mounting cavity is formed in the housing, the compressor 1 is connected to the housing and located in the mounting cavity, and the compressor 1, through the protection of the housing, will not be affected by external environment, thereby ensuring the accurate operation of the compressor 1.

Further, the refrigeration device can be home appliance devices, such as, a refrigerator and an air conditioner.

In the present disclosure, the term "a plurality of" refers to two or more, unless explicitly defined otherwise. The terms such as "installation", "connected", "connecting", "fixation" and the like shall be understood in broad sense, and for example, "connecting" may be a fixed connection, a detachable connection, or an integral connection; "connected" may be directly connected, or indirectly connected through an intermediary. The specific meaning of the above terms in the present disclosure will be understood by those of ordinary skills in the art, as the case may be.

In the illustration of the description, the illustration of the terms of "one embodiment", "some embodiments", "specific embodiment", etc. means that the specific features, structures, materials, or characteristics described in conjunction with the embodiments or examples are included in at least one embodiment or example of the present disclosure. In this description, schematic representations of the above terms do not necessarily refer to the same embodiment or example. Moreover, the specific features, structures, materials, or characteristics described may be combined in any suitable manner in any one or more embodiments or examples.

The foregoing is only a preferred embodiment of the present disclosure and is not intended to limit the present disclosure. For those skilled in the art, the present disclosure can have various modifications and changes. Any modification, equivalent replacement, improvement, etc. that made within the spirit and principle of the present disclosure are intended to be included within the scope of the present disclosure.

What is claimed is:

1. A compressor comprising:

a shell defining a cavity;

a compression assembly, wherein a part of the compression assembly is fixedly connected to the shell and located in the cavity, and the cavity is divided into a first cavity and a second cavity by the compression assembly;

a motor, wherein a part of the motor is arranged in the first cavity, wherein a part of the shell located below a central axis of the motor is a first shell, and wherein the motor comprises:

a crankshaft, wherein a first end of the crankshaft is located in the first cavity, and a second end of the crankshaft is connected to the compression assembly;

a rotor, sleeved on the first end of the crankshaft; and a stator, sleeved on an outer-side wall of the rotor, wherein an interval is formed between at least a part of an outer-side wall of the stator and an inner-side wall of the shell;

an oil sump arranged in the second cavity; and an oil return channel arranged in the compression assembly and configured to communicate the first cavity with the second cavity, wherein:

the oil return channel is provided with an oil inlet facing the first cavity, and the oil inlet has a dividing line parallel to a horizontal plane where the central axis of the motor is located, a distance between the dividing line and an inner-side wall of the first shell is a first relative distance, the first relative distance is greater than 0 mm and less than or equal to 12% of an inner diameter of the shell, and a sectional area of the interval on a cross section of the crankshaft is a first sectional area, a sectional area of the oil return channel on a cross section of the crankshaft is a second sectional area, and the second sectional area is less than or equal to 30% of the first sectional area.

2. The compressor according to claim 1, wherein:

the oil inlet comprises an oil through area which is located at one side of the dividing line departing from the central axis of the motor, and an area of the oil through area is greater than or equal to 90% of an area of the oil inlet and less than or equal to the area of the oil inlet.

3. The compressor according to claim 2, wherein the first relative distance is greater than 0 mm and less than or equal to 10 mm.

4. The compressor according to claim 1, wherein the first relative distance is greater than 0 mm and less than or equal to 7 mm.

5. The compressor according to claim 1, wherein:

the oil inlet has an apex away from a horizontal plane where the central axis of the motor is located, a distance between the apex and the inner-side wall of the first shell is a second relative distance, and the second relative distance is greater than or equal to 0 mm and less than or equal to 3 mm.

6. The compressor according to claim 5, wherein a part of the compression assembly is concaved towards a direction close to the central axis of the motor, so as to form the oil return channel.

7. The compressor according to claim 1, wherein:

the number of the interval is at least two, and the first sectional area is a sum of the sectional areas of the at least two intervals, and the number of the oil return channel is at least two, and the second sectional area is a sum of the sectional areas of the at least two oil return channels.

8. The compressor according to claim 1, wherein the compression assembly comprises:

an air cylinder; and a main bearing, provided at a side of the air cylinder facing the motor, wherein a part of the motor penetrates the main bearing and connects the air cylinder, wherein one of the main bearing and the air cylinder, which is fixedly connected to the shell, is a fastener, and the oil return channel is provided on the fastener.

9. The compressor according to claim 1, further comprising:

an exhaust pipe provided on the shell corresponding to the compression assembly; and an airflow channel provided on the compression assembly, wherein the airflow channel, the first cavity and the exhaust pipe are communicated with one another.

10. The compressor according to claim 1, further comprising:

a base; and a mounting rack, connected to a side of the base facing the shell, wherein the mounting rack is adapted and connected to the shell.

11. A refrigeration device comprising:

a housing comprising a mounting cavity; and a compressor according to claim 1, wherein the compressor is connected to the housing and located in the mounting cavity.

* * * * *